US009073108B2

(12) United States Patent
Elder

(10) Patent No.: US 9,073,108 B2
(45) Date of Patent: Jul. 7, 2015

(54) MOBILE CONDUIT FABRICATION WORK CART FOR JOBSITE USE

(71) Applicant: Doyle Elder, Arapaho, OK (US)

(72) Inventor: Doyle Elder, Arapaho, OK (US)

( * ) Notice: Subject to any disclaimer, the term of this patent is extended or adjusted under 35 U.S.C. 154(b) by 177 days.

(21) Appl. No.: 13/688,197

(22) Filed: Nov. 28, 2012

(65) Prior Publication Data

US 2014/0144201 A1 May 29, 2014

(51) Int. Cl.
*B21D 7/04* (2006.01)
*B21D 7/024* (2006.01)
*B21D 7/06* (2006.01)

(52) U.S. Cl.
CPC ..... *B21D 7/024* (2013.01); *B21D 7/063* (2013.01)

(58) Field of Classification Search
CPC ..... B21D 7/024; B21D 7/063
USPC ..... 72/18.1, 31.04, 33, 34, 35, 295, 301, 72/305, 308, 311, 316, 322, 323, 389.6, 72/386, 388
See application file for complete search history.

(56) References Cited

U.S. PATENT DOCUMENTS

| | | | | |
|---|---|---|---|---|
| 3,075,568 | A * | 1/1963 | Bright | 72/18.1 |
| 3,396,565 | A | 8/1968 | Miller | |
| 3,581,537 | A * | 6/1971 | Lance et al. | 72/31.04 |
| 3,731,513 | A * | 5/1973 | Kindermann et al. | 72/388 |
| 3,760,626 | A | 9/1973 | Sharar | |
| 3,935,721 | A | 2/1976 | Boteler et al. | |
| 3,981,173 | A | 9/1976 | Nobinger | |
| 4,037,457 | A * | 7/1977 | Henderson | 72/389.6 |
| 4,558,583 | A | 12/1985 | Shaw, Sr. et al. | |
| 5,058,407 | A | 10/1991 | Parker | |
| 5,222,384 | A | 6/1993 | Evans | |

* cited by examiner

*Primary Examiner* — David B Jones
(74) *Attorney, Agent, or Firm* — James F Harvey, III

(57) ABSTRACT

An apparatus and associated method for bending a metal conduit. A structural framework defines an elongated rectangular planar layout surface sized to continuously contact the metal conduit in support while making a bend mark on the metal conduit. A coordinate reference measures a placement of the bend mark on the metal conduit. A grooved bending shoe is mounted to the framework and configured to bend the metal conduit.

18 Claims, 9 Drawing Sheets

MOBILE CONDUIT FABRICATION WORK CART FOR JOBSITE USE

CROSS-REFERENCES TO RELATED APPLICATIONS

This patent application claims the benefit of the earlier filing date of U.S. Provisional Patent Application Ser. No. 61/564,281 filed on Nov. 28, 2012, having same or similar title, the contents of which are hereby incorporated by reference in their entirety.

BACKGROUND OF THE INVENTION

The present invention generally relates to jobsite construction activities, and, in particular and without limitation, to on-site conduit fabrication.

Electrical contractors tasked with wiring a building frequently must provide protective conduit through which the electrical wires are pulled. These protective conduits are generally composed of metallic materials, although some conduit may be composed of polyvinyl chloride materials. Methods have been developed by the electricians to measure and custom-bend the conduit to accommodate a wiring plan for the building, and such methods involve measuring long length of conduit, bending the conduit to bypass obstacles, and cutting the conduit to length. These activities generally involve the electrician laying the conduit on the floor, measuring lengths of conduit, cutting the conduit to length with a hacksaw or specialty tools, and bending the conduit to the desired configuration with a handheld conduit bender.

The mechanical conduit benders in use today consist of a bending head with a circular circumferential groove sized to fit the diameter of the conduit being bent and a hook to engage the conduit in the groove. A long handle is attached to an extension from the center of curvature, generally about three to five feet long, which the electrician uses to lever one end of the conduit against the floor to bend the other end of the conduit upwardly. These activities of measuring and bending involve much squatting and bending on the part of the electrician and can induce stress and fatigue by the end of the day. Furthermore, the electrician's handtools—saws, measuring tapes, conduit bender, levels, squares, and the like—tend to get scattered about the floor and can provide a tripping hazard, or they can be stepped on and possibly damaged. Stocks of conduit are stacked about the area waiting for use, and they may be dislodged to roll across the floor or prove hazardous to foot traffic.

As can be seen, there is a need for portable workbench to provide a worksurface at a comfortable height for common conduit bending, cutting, and fabrication activities. The portable workbench should be in the form of a cart with wheels sufficiently large to roll over low obstacles; it should enable the electrician to move his equipment rapidly to the proximity of the area in which conduit is being installed and provide storage capacity for conduit stock and electrician's tools. The workbench should also enable the electrician to rapidly measure and assemble the desired conduit configuration at a comfortable height that does not unduly fatigue the electrician.

SUMMARY OF THE INVENTION

A system and mobile apparatus for bending a metal conduit is provided, embodiments of which comprise a structural framework defining an elongated rectangular planar layout surface sized to continuously contact the conduit in support while making a bend mark on the conduit. A coordinate reference may be provided to measure a placement of the bend mark on the conduit. A grooved bending shoe may be mounted to the framework and configured to bend the conduit to a desired curvature.

An apparatus is provided, which comprise a structural framework having a rectangular frame supporting a planar layout surface sized to continuously support an elongated piece of metal conduit while making a bend mark on the conduit. In some embodiments, the frame comprises opposing lateral end frame members joined to opposing longitudinal side frame members. A grooved bending shoe may be mounted to the framework and configured to rotate around an axis of rotation in order to bend the conduit. A coordinate reference may be provided to measure a placement of the bend mark on the conduit. The coordinate reference includes a linear indicia on the planar layout surface. The coordinate reference may also include a rigid positive stop attached to one of the end frame members and defining a first abutment surface extending above the planar layout surface. The coordinate reference may further include an articulating positive stop attached to the same end frame member defining a second abutment surface that is selectively positionable at a first distance from the planar layout surface and at a different second distance from the planar layout surface. The first and second abutment surfaces are substantially coplanar at both selected positions of the second abutment surface. An angular indicia may be supported by the framework to indicate the angular position of the bending shoe.

A method is also provided for bending a metal conduit, the method comprising the steps of providing a bending apparatus having a structural framework that defines an elongated rectangular planar layout surface sized to continuously contact the conduit in support while making a bend mark on the conduit, and having a grooved bending shoe mounted to the framework and configured to bend the conduit. The method continues by placing the conduit on the layout surface, and aligning the conduit with a coordinate reference. While the conduit is supported on the layout surface and aligned with the coordinate reference, the method includes the step of making the bend mark on the conduit indicating the location on the conduit for the bend. The method then includes the steps of aligning the bend mark with the bending shoe and bending the conduit with the bending shoe.

These and other features, aspects, and advantages of the present invention will become better understood with reference to the following drawings, description, and claims.

BRIEF DESCRIPTION OF THE DRAWINGS

FIG. 6 shows an enlarged isometric depiction of the bending shoe in the conduit bender of FIG. 1;

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims. The conduit handling and fabrication concepts herein are not necessarily limited to use or application with any specific workpiece and associated methods, although the illustrative embodiments are well suited for handling and fabricating electrical conduit. Thus, although the instrumentalities described herein are for the convenience of explanation, shown and described with respect to exemplary embodiments, it will be appreciated that the principles herein may be applied equally in other types of workpieces and associated methods of material handling and fabrication.

For purposes of this description and claims, the term "conduit" as used herein generally means a longitudinally extending and substantially rigid elongate member. Electrical conduit is an example of one type of conduit that is well suited as a workpiece for practicing the embodiments of the present invention, although use on electrical conduit is merely illustrative and not limiting of the contemplated embodiments. Thin-walled piping and solid architectural components of construction are examples of other types of conduits encompassed generally by the term for the purposes of this description and claims.

Embodiments of the invention provide an apparatus and associated methodology for plastically bending a conduit to a desired non-linear shape. Electrical conduit is used to construct raceways for routing and shielding electrical wires. Popular types of electrical conduit include intermediate metal conduit (IMC), electrical metallic tubing (EMT), and rigid metal conduit (RMC). These types of metallic conduit are commercially available most often in eight foot or ten foot lengths. The straight lengths may be custom-formed to follow a desired route from an electrical source to an electrical outlet or device. For example, a straight length of the conduit is often formed with a "stub up," which is a short ninety degree bent end that connects to a terminal box, with the remaining "tail" portion running horizontally or vertically to an electrical distribution source such as a breaker box. Offsets are often formed in the tail portion to divert the conduit around obstacles in the path.

Figure 1:
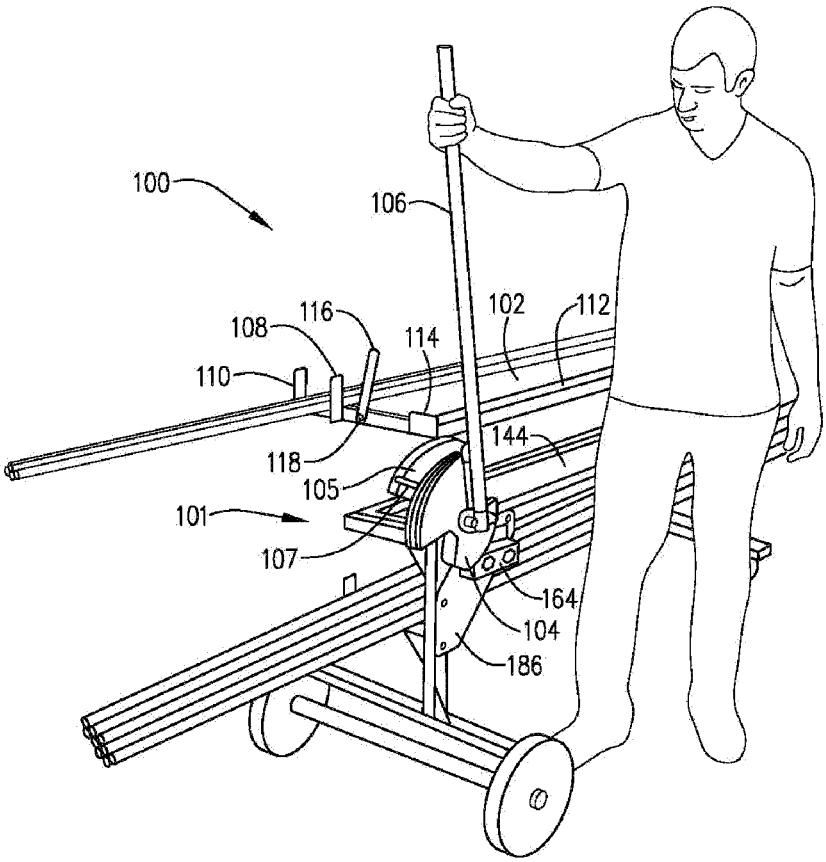
FIG. 1 shows an isometric depiction of a conduit bender that is constructed and used in accordance with embodiments of the present invention.

Referring now to FIG. 1, an isometric depiction of a mobile conduit bender 100 is shown. The mobile conduit bender 100 is constructed in accordance with illustrative embodiments of the present invention. The bender 100 generally has a structural framework 101 that defines an elongated rectangular planar layout surface 102, which is sized to continuously contact a piece of the conduit while making a bend mark on the conduit. In these illustrative embodiments, the continuous contacting support is provided by a solid layout surface 102, but in equivalent alternative embodiments some weight could be removed by using an expanded metal surface or a perforated material and the like without departing from the scope of the invention. The planar layout surface 102 may advantageously provide a work surface large enough to support a piece of the conduit while making bend marks on the conduit for bending the conduit. In the illustrative embodiments depicted in FIG. 1, the layout surface 102 may be a little longer than five feet long, and the framework 101 may be open-ended to support longer bundles and individual pieces of the conduit.

The bender 100 may also have a grooved bending shoe 104 attached to the framework 101. In these illustrative embodiments, the bending shoe 104 may be mounted for rotation around a horizontal axis of rotation, although the claimed embodiments are not so limited. As discussed below, in alternative embodiments, the bending shoe 104 may be mounted so that the axis of rotation may be selectively oriented, such as a vertical axis of rotation. An angular indicia 105 may be provided with graduations in angular increments, such as degrees. A pointer 107 may be fixed in rotation with the bending shoe 104 to extend to the angular indicia 105. The angular indicia 105 and pointer 107 may be conveniently arranged so that, for example, the pointer 107 may indicates "0" on the angular indicia 105 when a straight piece of conduit is loaded to the bender 100, and the pointer 107 moves to "45" on the angular indicia when a 45° bend has been imparted to the conduit by the bender 100. Thus, the pointer 107 may provide a visual indicator of the amount of curvature imparted to the conduit by the bender 100 and thus improve repeatability and precision of measurement for multiple conduit workpieces.

The user in FIG. 1 is depicted as grasping a handle 106 that is fixed at a proximal end in rotation with the bending shoe 104. The strength and length of the handle 106 may provide sufficient leverage enabling the user to bend the conduit by exerting a rotational force by hand. For bending larger or thicker-walled conduit, the bending shoe 104 may alternatively be selectively rotated by a motor (not depicted) or a pneumatically-assisted lever (not depicted). Other means of providing a force required to actuate the bending shoe, and thus bend the conduit, may be used without departing from the scope of the invention.

The framework 101 may also provide storage areas for multiple bundles of the conduit. Preferably, as better viewed below, the storage areas are accessible for loading the bundles of conduit sideways into the framework 101 instead of inserting them from one end of the framework 101. Mounting the framework 101 on wheels (and/or casters) may facilitate moving the conduit bender 100 to different locations as the on-site conduit fabrication progresses. In alternative embodiments, the framework 101 may include adequate lifting portions for moving the bender 100 by use of a material handling device such as a pallet jack or a forklift and the like.

A queue for staging one of the opened bundles of conduit on the layout surface 102 may be provided by upstanding stops 108, 110. This may permit retrieving the next conduit from the planar layout surface 102, with the height of the planar layout surface 102 and of the grasping location of the handle 106 being ergonomically advantageous, in that multiple pieces of conduit can be obtained, marked, and then bent while the user maintains a substantially neutral torso and neck body position. This advantageously prevents any need for the user to continually stoop over during the conduit fabrication process as is customary with other attempted solutions in this art.

The planar layout surface 102 advantageously not only supports the conduit while marking it, but also keeps all the necessary tools at hands-reach during the conduit fabrication process. For example, a level and a marking pencil are depicted where they are immediately within reach while not interfering with the space needed to support the next conduit while marking it. Preferably, a linear indicia 112 may be provided on the layout surface 102 for measuring the placement of the bend marks. In these illustrative embodiments, the linear indicia 112 is a five-foot ruler attached to the layout surface 102, although the contemplated embodiments are not so limited, e.g. the linear indicia 112 may be directly marked on or etched into the layout surface 102 and the like.

Figure 2:
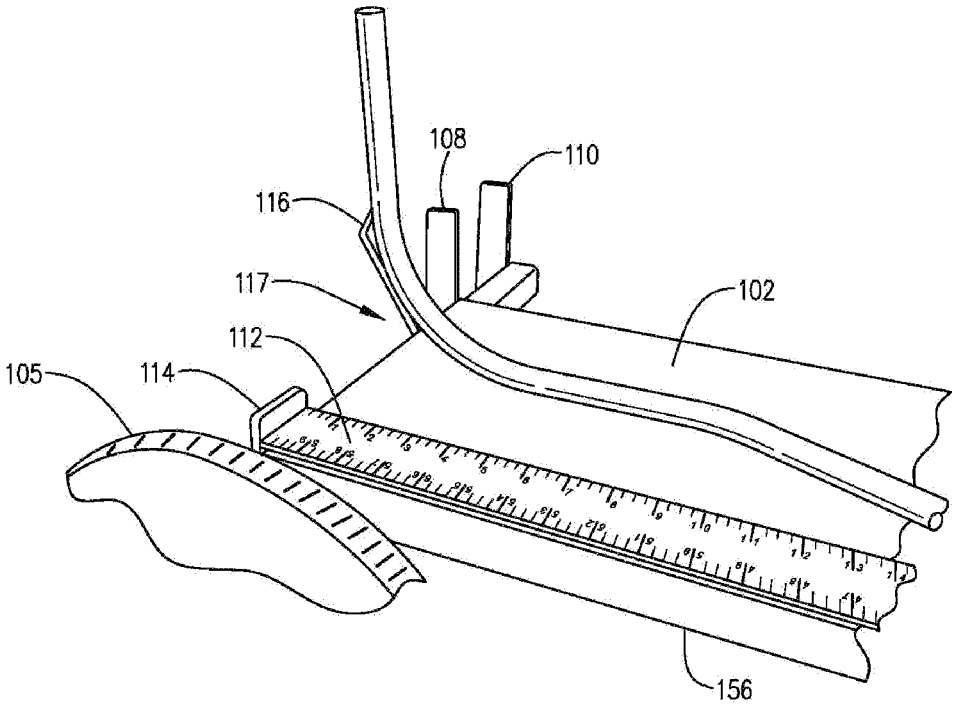
FIG. 2 shows; an enlarged isometric depiction of a portion of the conduit bender of FIG. 1, according to an embodiment of the invention.

In fabricating conduit to have a desired bend shape, the user can abuttingly engage one end of the conduit, while supported on the layout surface 102, against a rigid positive stop 114 that extends upwardly from the layout surface 102 and is longitudinally aligned with the linear indicia 112. That advantageously aligns another portion of the conduit on the linear indicia 112 for measuring the placement of the bend mark. For example, a straight piece of conduit can be abutted against the positive stop 114 and marked with a bend mark according to the graduations on the linear indicia 112. Another selectively moveable positive stop 116 may articulate around a pivot axis 118. The positive stop 116 can thereby be rotationally positioned to abuttingly engage a previously bent portion of the conduit. FIG. 2 shows an enlarged view depicting the positive stop 116 rotated to a position where it can abuttingly engage a previously bent portion of the conduit that is non-contactingly disengaging the layout surface 102. That position of the positive stop 116 may also permit supporting another portion of the conduit on the linear indicia 112 for measuring the placement of the bend mark (not depicted).

Both the rigid positive stop 114 and the moveable positive stop 116 define abutment surfaces that are equivalently aligned with the linear indicia 112. That is, the moveable positive stop 116 is selectively positionable at a first distance above the layout surface 102 and at a different second distance above the layout surface 102. The abutment surface of the rigid positive stop 114 is substantially coplanar with the abutment surface of the moveable positive stop 116 at all possible positions of the moveable positive stop 116. The stops 114, 116 and linear indicia 112 cooperatively provide a coordinate reference 117 permitting the user to measure and mark bend lines on the metal conduit without any need for using hand tools such as hand held measuring devices and hand held squaring device and the like. The linear indicia 112 is not limited to a graduated ruler as depicted in these illustrative embodiments; alternatively the indicia can be in the form of markings or detents formed in or as a part of the planar layout surface 102.

Figure 3:
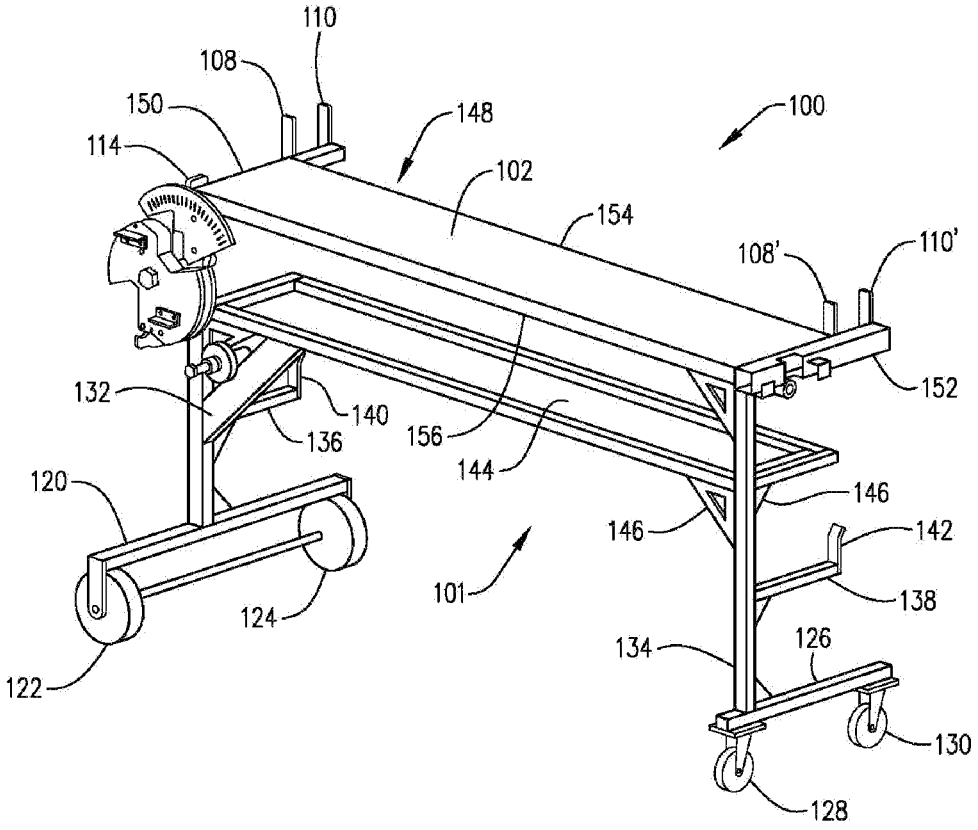
FIG. 3 shows an isometric depiction of the conduit bender of FIG. 1.

FIG. 3 is an isometric depiction of the bender 100 completely unloaded for clarity sake in this further description of the framework 101. In these illustrative embodiments a spreader bar 120 provides lateral support to one end of the layout surface 102. The bender 100 is made mobile by supporting the spreader bar 120 upon a pair of axle-mounted wheels 122, 124. Another spreader bar 126 supported upon individually multi-directional casters 128, 130 provides lateral support to the other end of the layout surface 102. Preferably, the casters 128, 130 are provided with locking mechanisms to prevent rotation during conduit layout and bending operations.

Upright columns 132, 134 extend from the spreader bars 120, 126, respectively. Lateral shelf members 136, 138 with upstanding distal ends 140, 142 are cantilevered from the columns 132, 134. Bundles of the conduit are easily stored and retrieved by the sideways-accessibility of the spreader bars 120, 126 and the shelf members 136, 138 as depicted in FIG. 1.

As mentioned, the layout surface 102 is positioned at an ergonomically advantageous height, such as a workbench height, for neutral body positioning during marking the conduit. This leaves adequate room for a storage shelf 144 that is cantilevered from the columns 132, 134 above the shelf members 136, 138. Gussets 146 may be included as necessary for the desired structural strength.

In these illustrative embodiments, a rectangular frame 148 is supported upon the columns 132, 134 and, in turn, supports the layout surface 102. The rectangular frame 148 is formed by opposing end frame members 150, 152 joined to opposing side frame members 154, 156 such as by welding and the like. The rigid positive stop 114 and the moveable positive stop 116 (FIG. 2) are attached to the end frame member 150. In these illustrative embodiments the other end frame member 152 may be configured to provide a vise for selectively clamping the conduit during common secondary operations such as, for example, cutting, deburring, drilling, and grinding the conduit.

Figure 4:
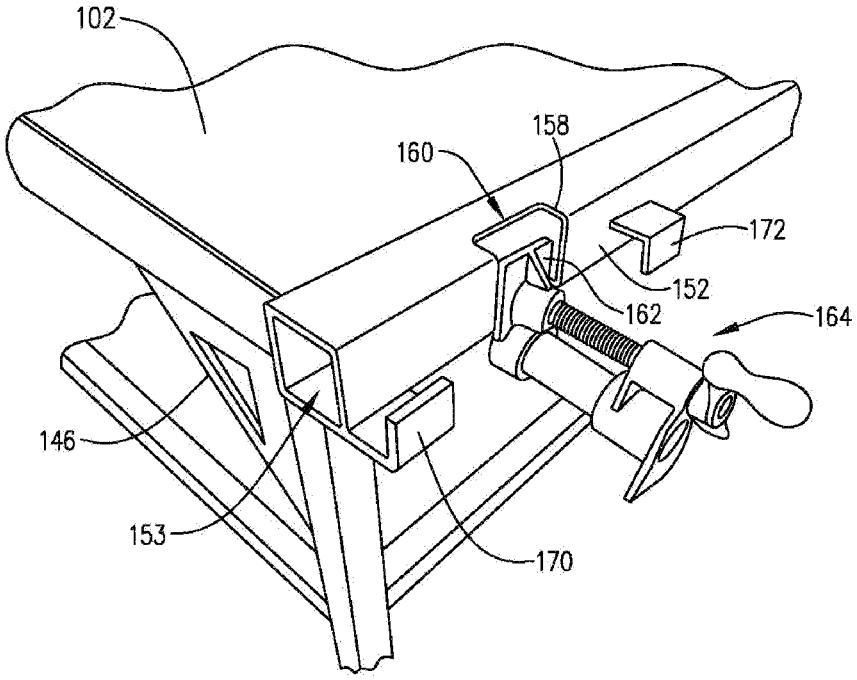
FIG. 4 shows an isometric depiction of the vise portion of the conduit bender of FIG. 1.

FIG. 4 is an enlarged isometric view of the end frame member 152 configured to provide a vise in accordance with embodiments of the present invention. The end frame member 152 is a hollow longitudinal member, such as the square tubing construction depicted, with an internal cavity 153 that is large enough to receivingly engage the conduit. An edge 158 defines an opening 160 into which a clamping jaw 162 is selectively moveable. In these illustrative embodiments, the clamping jaw 162 is part of a pipe clamp 164 that is attachable to the end frame member 152. After being attached, the pipe clamp 164 can be operated to advance the clamping jaw 162 through the opening 160 and to pressingly engage a conduit in the cavity 153 against an inner surface of the end frame member 152.

Figure 5:
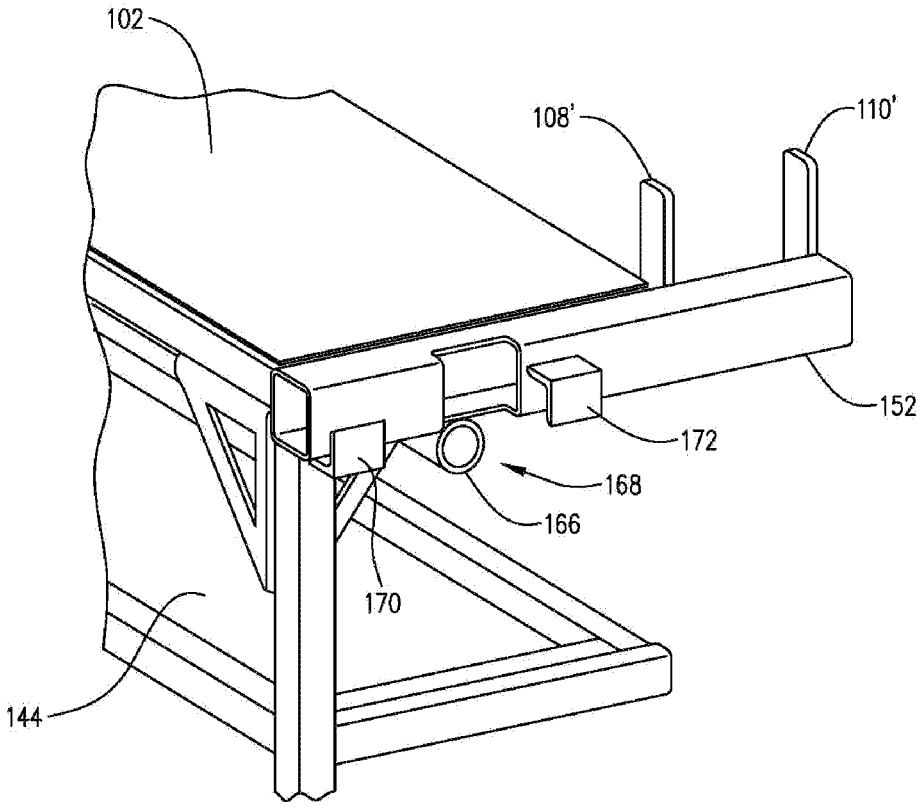
FIG. 5 shows an isometric depiction similar to FIG. 4 but with the pipe clamp removed, according to an embodiment of the invention.
Figure 5:
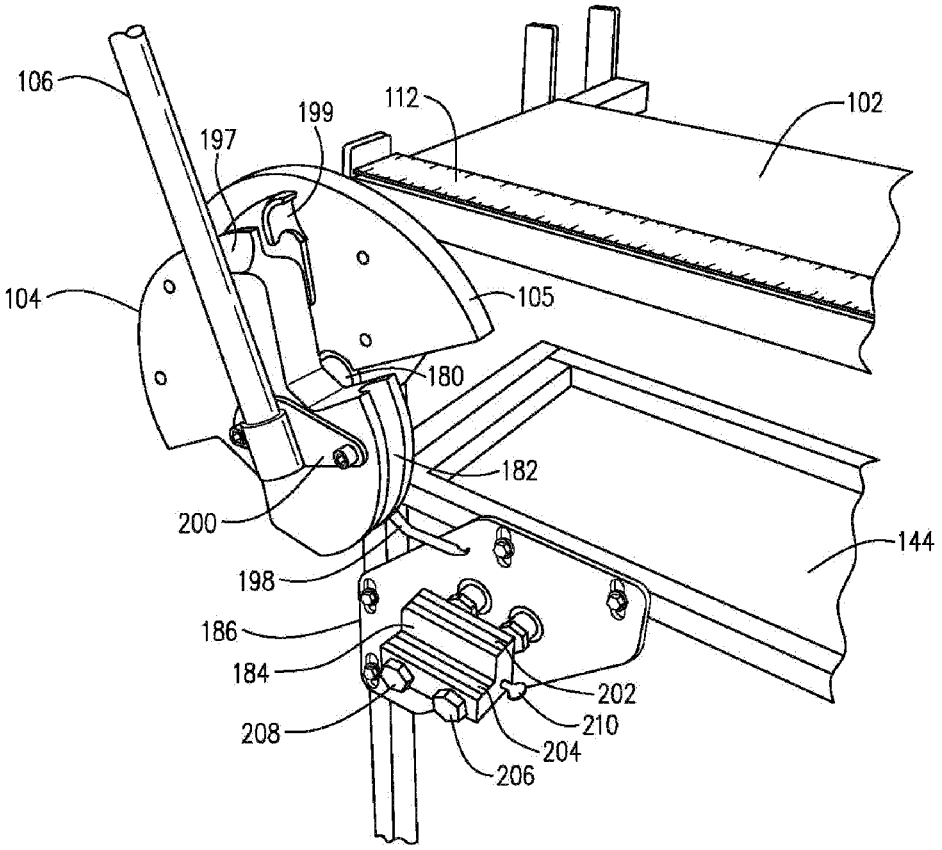

FIG. 5 is a view similar to FIG. 4 but with the pipe clamp 164 removed to reveal a mounting flange 166 defining an aperture 168. The aperture 168 may be provided with an attachment feature to secure the pipe clamp 164 in opposition to the clamping force exerted on the conduit in the vise. For example, the aperture 168 may be threaded to matingly engage a threaded end of the pipe clamp, or the aperture 168 may define an L-shaped slot for receiving and locking a protuberant key on the pipe clamp, or the like.

FIGS. 4 and 5 also depict support features on the end frame member 152 that in some instances are easier and faster to use than the vise. For example, cutting the conduit requires an upward support force to counter the downward sawing force, and preferably a lateral support to counter the tendency of the conduit to roll while being sawed. The vise as described is well suited for clamping the conduit during sawing. However, alternatively the pipe clamp 164 can be removed and the conduit placed in an upright channel 170 near the cut mark, and with the conduit otherwise captured in an inverted channel 172, wherein both channels 170, 172 extend from the end frame member 152.

FIG. 6 is another view of the bending shoe 104 at roughly the same rotational orientation as in FIG. 1. In these illustrative embodiments, a shaft 180 extends from the upright column 132 of the framework, providing a bearing member around which the bending shoe 104 is journalled for rotation. In alternative embodiments, the bending shoe 104 may have a protuberant shaft that is journalled for rotation by a receiving member supported by or formed as a portion of the framework 101.

Figure 7:
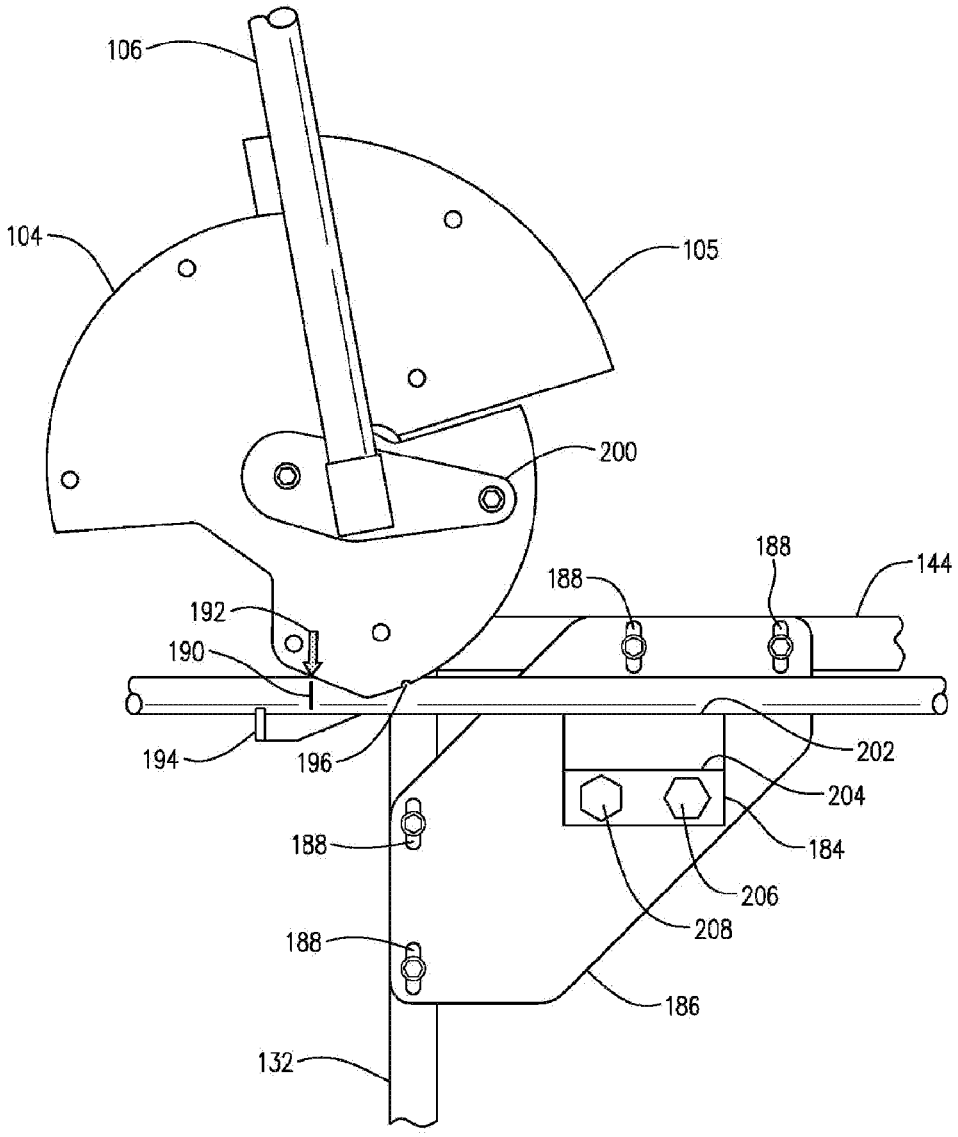
FIG. 7 shows a side elevational depiction of the bending shoe and conduit support in the conduit bender of FIG. 1.

The bending shoe 104 has a first groove 182 that is sized for bending a first size conduit. FIG. 6 depicts the bending shoe 104 rotated to a position for receiving the next conduit for bending. FIG. 7 is similar to FIG. 6 but depicting the conduit in place for bending. A conduit support 184 is supported by the framework 101 adjacent to the bending shoe 104 to support one portion of the conduit in a substantially horizontal orientation while another portion of the conduit is bending. In these illustrative embodiments the conduit support 184 is attached to the framework 101 by a mounting plate 186 attached to the upright column 132 and to the storage shelf 144. Preferably, that attachment is by way of slotted openings 188 to permit a vertical adjustment of the conduit support 184 relative to the bending shoe 104.

The conduit in FIG. 7 is depicted as having a bend mark 190 previously placed on the conduit while marking it on the layout surface 102 (FIG. 1). The user aligns the bend mark 190 with an arrow 192 marked on the bending shoe 104 to begin a bend at the bend mark 190. The conduit extends ahead of the bend mark to engage a hook 194 which is fixed in rotation with the bending shoe 104. The hook 194 grips the conduit as the bending shoe 104 is rotated clockwise, exerting the force that bends the conduit against the arcuate surface of the first groove 182. A notch 196 is provided to indicate the center of a forty-five degree angle to the conduit.

In these embodiments the bending shoe 104 has a second groove 197 on the other side that is sized for bending a different size conduit. To switch to bending with the second groove 197 the user may rotate the bending shoe 104 by 180° and proceed in the same manner. In that orientation, a second pointer 198 is aligned with the angular indicia 105 for measuring the angular position of the bending shoe. Similarly, a second hook 199 is placed in position to grip the conduit for bending against the second groove 197 of the bending shoe 104. The handle 106 must be repositioned in order to rotate the bending shoe 104 one-half revolution for this purpose. For that reason, it is advantageous to provide for a quick-release attachment of the handle 106 to the bending shoe 104. In these illustrative embodiments, the end of the handle 106 threadingly engages a hub 200, which is fixed in rotation with the bending shoe 104. To switch to bending with the second groove 197, the user unscrews the handle 106 from the hub 200, rotates the bending shoe 104 one-half rotation, and then screws the handle 106 back into the hub 200 from the opposite direction which is now upwardly pointing as depicted in FIGS. 1 and 6.

The conduit support 184 in the illustrative embodiments of FIGS. 6 and 7 generally provides an elongated planar surface upon which the conduit slidingly engages during bending. A first planar surface 202 is used when bending with the first groove 182, and a second planar surface 204 is alternatively used when the conduit bender 100 is switched over to bend conduit with the second groove 197. The conduit support 184 is slidingly supported upon the sleeve portions of a pair of bolts 206, 208 to align the desired planar surface 202, 204, and tightening a thumbscrew 210 secures the conduit support 184 at the desired operable position.

All the foregoing description of the bending shoe 104 being mounted for rotation around a horizontal axis of rotation is merely illustrative, not limiting of the contemplated embodiments of the claimed invention. For example, in alternative embodiments the bending shoe 104 may be mounted to the framework 101 for rotation around a vertical axis, or any other axis for that matter. The horizontally-rotating embodiments depicted herein are conceivably limited by the vertical spacing from the bending shoe 104 to the supporting floor. That is, it is possible that one bend in the conduit might cause the conduit to interfere with the ground surface when positioning the conduit for a subsequent bend. Most times that can be prevented by a thoughtful reordering of the bend steps, or by splicing conduits together, or perhaps by making a bend with a hand bender. Alternatively, a vertically-rotating bending shoe (not depicted) can lessen the likelihood of this problem by raising the conduit higher from the ground surface and bending it in a plane parallel to the ground surface.

Figure 8:
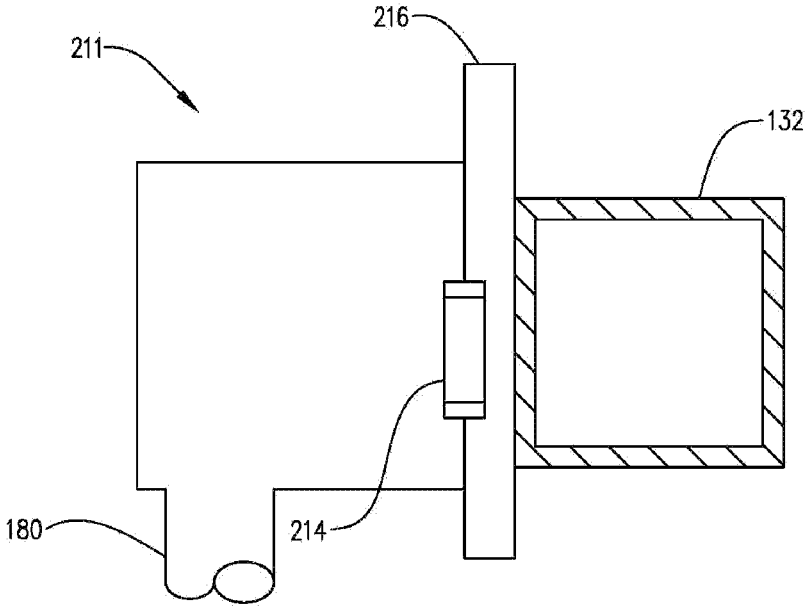
FIG. 8 diagrammatically shows an adjustable mounting block positioning the bending shoe in a horizontally-rotating orientation, according to one embodiment of the invention.
Figure 9:
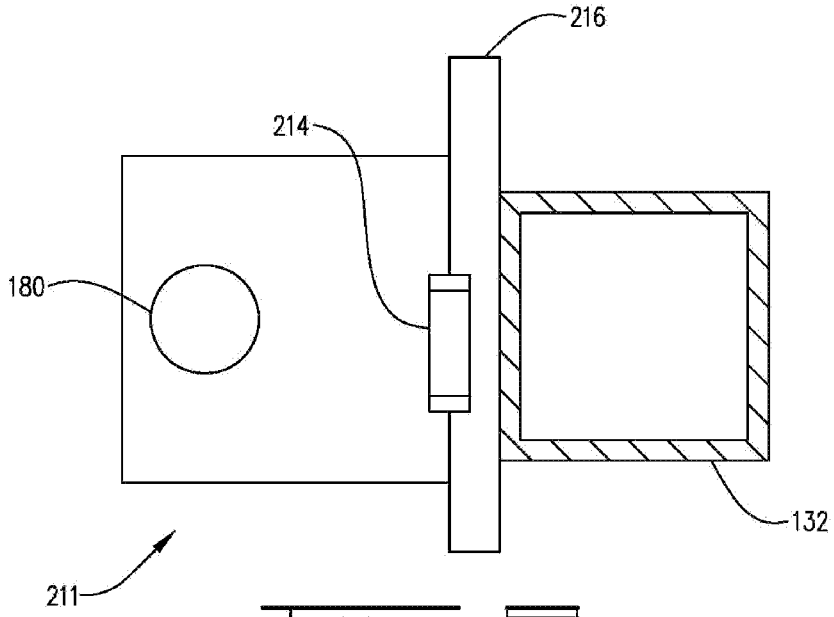
FIG. 9 is similar to FIG. 8 but depicts the mounting block positioning the bending shoe in a vertically-rotating orientation, according to another embodiment of the invention.

In some contemplated embodiments the conduit bender can be constructed to selectively alternate between a horizontally-rotating and a vertically-rotating bending shoe 104. For example, FIG. 8 diagrammatically depicts alternative embodiments of supporting the shaft 180 (see FIG. 6) around which the bending shoe 104 is journalled for rotation. Here, instead of being directly attached to the upright column 132 as described above, the shaft 180 is supported by a mounting block 211 which is, in turn, attached to the upright column 132. In these simplified illustrative embodiments the mounting block 210 has an outboard block 212 that is journalled by a bearing 214 for rotation relative to a flange 216 that is affixed to the upright column 132. FIG. 8 depicts the shaft 180 in a horizontal position as described in the illustrative embodiments of the description above. The mounting block 211 may be maintained in this horizontally-rotating position such as by pinning the block 212 to the flange 216 (not depicted), and the like. When vertically-rotating bending is desired, the mounting block 211 can be unpinned, rotated ninety degrees as depicted in FIG. 9, and repinned to maintain that bending orientation.

Figure 10:
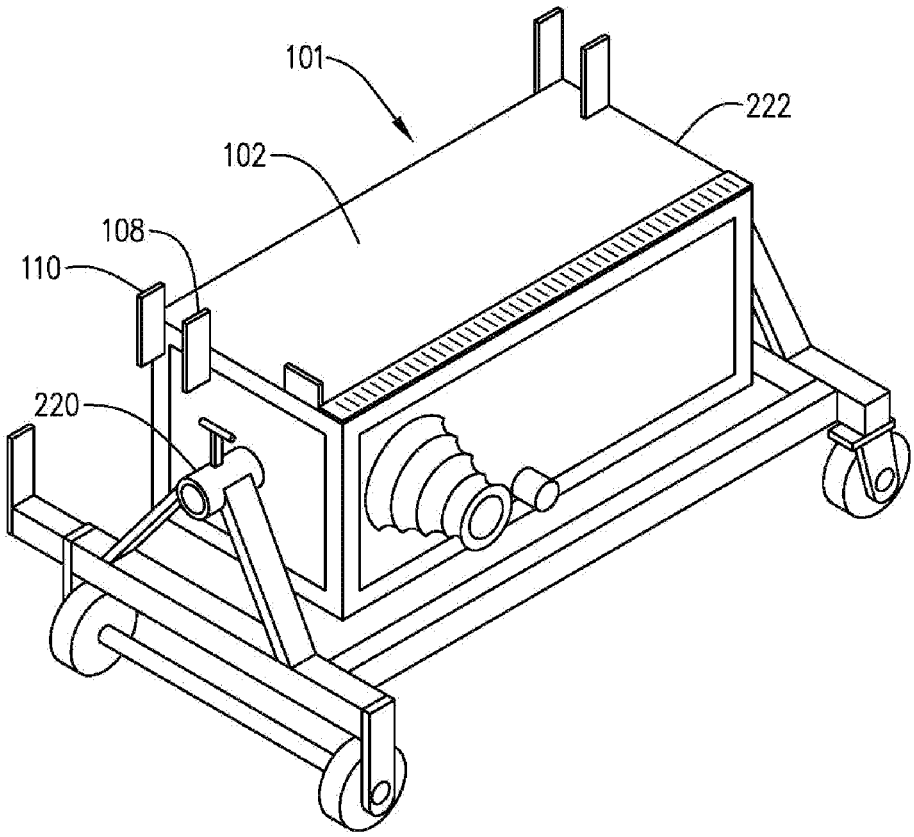
FIG. 10 shows an isometric diagrammatic depiction of pivotally mounting the framework in the conduit bender of FIG. 1.

In yet other illustrative embodiments for changing the axis of rotation, some part of or the entire framework 101 can be made to be selectively rotatable. FIG. 10 diagrammatically depicts the entire framework 101 as a rectangular cuboid for purposes of representing how it can be longitudinally supported between opposing pivots 220, 222. Although not depicted, it will be understood that alternatively only part of the framework 101 that supports the bending shoe 104 can be supported in this manner between longitudinally opposing pivots 220, 222. The framework 101 may be rotated manually or by power-assist, such as by the use of a motor or a fluid cylinder and the like. A latch (not shown) is selectively engaged to maintain the framework 101 at the desired rotational position for either horizontally or vertically oriented conduit bending.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. Further, although the illustrative embodiments described herein are directed to handling metallic workpieces, it will be appreciated by those skilled in the art that the claimed invention can be applied to other elongate, ductile workpieces requiring angular shaping as well without departing from the spirit and scope of the present invention. Modifications may be made without departing from the spirit and scope of the invention as set forth in the following claims.

I claim:

1. A mobile apparatus for bending a rigid conduit, the apparatus comprising:

a structural framework defining an elongated rectangular planar layout surface sized to continuously contact the conduit in support while making a bend mark on the conduit;

a vise attached to the framework;

a coordinate reference for measuring a placement of the bend mark on the conduit, the coordinate reference aligned along the layout surface to measure linear distance along the conduit as the conduit is supported by the layout surface; and a grooved bending shoe mounted to the framework and configured to bend the conduit, the bending shoe rotating about an axis.

2. The apparatus of claim 1, wherein the coordinate reference comprises a linear indicia on the planar layout surface.

3. The apparatus of claim 2, wherein the coordinate reference comprises a rigid positive stop extending upwardly from the layout surface and configured to abuttingly engage one portion of the conduit that is supported on the layout surface against the positive stop and longitudinally aligned with the linear indicia.

4. The apparatus of claim 2, wherein the coordinate reference comprises a positive stop that is selectively moveable and thereby abuttingly engageable with one portion of the conduit that is noncontactingly disengaging the planar layout surface to align another portion of the conduit on the linear indicia.

5. The apparatus of claim 1 comprising a bearing member supported by the framework to which the bending shoe is journalled to rotate around an axis.

6. The apparatus of claim 5 comprising an angular indicia supported by the framework and indicating the angular position of the bending shoe.

7. The apparatus of claim 5, wherein the bearing member is supported by a mounting block depending from the framework, and wherein the mounting block is selectively moveable to position the axis at a first angular orientation and at a different second angular orientation.

8. The apparatus of claim 7 wherein the first angular orientation is substantially horizontal and the second angular orientation is substantially vertical.

9. The apparatus of claim 5 wherein at least a portion of the framework is selectively moveable to position the axis at a first angular orientation and at a different second angular orientation.

10. The apparatus of claim 5 comprising a conduit support member supported by the framework adjacent the bending shoe to support one portion of the conduit while bending another portion of the conduit.

11. The apparatus of claim 10 wherein the conduit support member defines a planar surface upon which the conduit slidingly engages during bending.

12. The apparatus of claim 5 wherein the bending shoe defines a first groove sized to bend a first size conduit and the bending shoe defines a second groove sized to bend a different second size conduit.

13. The apparatus of claim 1 wherein the framework comprises:

a first spreader bar supported upon a first wheel;

a second spreader bar supported upon a second wheel;

a first upright column supported by the first spreader bar;

a second upright column supported by the second spreader bar; and a rectangular frame supported by the first and second columns and, in turn, supporting the planar layout surface, the rectangular frame having opposing lateral end frame members joined to opposing longitudinal side frame members.

14. The apparatus of claim 13, wherein the coordinate reference includes a rigid positive stop that is attached to one of the end frame members and defines a first abutment surface extending above the planar layout surface, and wherein the coordinate reference includes an articulating positive stop that is attached to the same end frame member defining a second abutment surface that is selectively positionable at a first distance from the planar layout surface and at a different second distance from the planar layout surface, wherein the first and second abutment surfaces are substantially coplanar at both selected positions of the second abutment surface.

15. The apparatus of claim 13, wherein the vise comprises a hollow longitudinal member sized to receivingly engage the conduit, the hollow longitudinal member defining an opening through which a clamping jaw is selectively moveable to pressingly engage the conduit against an inside surface of the hollow longitudinal member.

16. The apparatus of claim 15, wherein the hollow longitudinal member is one of the opposing lateral end frame members.

17. The apparatus of claim 13, wherein one of the end frame members has an external support member sized to support a portion of the conduit.

18. An apparatus comprising:

a structural framework having a rectangular frame supporting a planar layout surface sized to continuously support an elongated piece of metal conduit while making a bend mark on the conduit, the frame including opposing lateral end frame members joined to opposing longitudinal side frame members;

a vise connected to the framework;

a grooved bending shoe mounted to the framework and configured to rotate around an axis to bend the conduit; and a coordinate reference for measuring a placement of the bend mark on the conduit, the coordinate reference aligned along the layout surface to measure linear distance along the conduit as the conduit is supported by the layout surface, the coordinate reference including:

a linear indicia on the planar layout surface;

a rigid positive stop attached to one of the end frame members and defining a first abutment surface extending above the planar layout surface;

an articulating positive stop attached to the same end frame member defining a second abutment surface that is selectively positionable at a first distance from the planar layout surface and at a different second distance from the planar layout surface, wherein the first and second abutment surfaces are substantially coplanar at both selected positions of the second abutment surface; and an angular indicia supported by the framework and indicating the angular position of the bending shoe.

* * * * *